United States Patent [19]

Curington

[11] 4,278,135

[45] Jul. 14, 1981

[54] VARIABLE VOLUME PNEUMATIC DRILL

[75] Inventor: Alfred R. Curington, San Angelo, Tex.

[73] Assignee: Reedrill, Inc., Houston, Tex.

[21] Appl. No.: 902,378

[22] Filed: May 3, 1978

[51] Int. Cl.[2] ..... B25D 9/00; F01L 1/20

[52] U.S. Cl. ..... 173/29; 91/54; 91/245; 91/277; 173/115; 173/136

[58] Field of Search ..... 91/54, 232, 233, 245, 91/277; 92/59, 60.5, 128; 173/17, 29, 115, 136

[56] References Cited

U.S. PATENT DOCUMENTS

| | | | |
|---|---|---|---|
| 1,083,369 | 1/1914 | Le Gendre | 92/59 X |
| 1,539,215 | 5/1925 | Skaer | 91/54 |
| 3,032,013 | 5/1962 | Vincent | 173/115 |
| 3,896,886 | 7/1975 | Roscoe | 173/17 |
| 3,944,003 | 3/1976 | Curington | 173/17 |
| 3,958,645 | 5/1976 | Curington | 173/17 |

*Primary Examiner*—Lawrence J. Staab
*Attorney, Agent, or Firm*—Michael J. Caddell; Neal J. Mosely

[57] ABSTRACT

A Pneumatic impact drilling tool, particularly useful as a downhole pneumatic drill, includes a housing structure adapted to be connected to a string of drill pipe and supplied with compressed air therethrough. A hammer piston reciprocates in the housing structure along flexible feed and exhaust tubes. Compressed air is directed alternately to the upper and lower ends of the hammer to effect its reciprocation in the housing. The hammer is operable to strike an anvil bit member repeatedly to effect a drilling motion. At the upper end of the housing there is provided a removable annular plug member surrounding the tubular support in which the feeder tube is positioned. The annular plug member defines the volume of the space above the hammer piston and is related to the size of the feeder tube so that the feeder tube and plug member together determine the volume of air utilized at any selected air pressure and the timing of operation of the hammer position. The feeder tube and plug member are removably positioned on the supporting member as a set and maybe replaced with like sets of feeder tubes and plug members of different size to permit the operation of the drilling tool at various selected air flow rates and air pressures.

10 Claims, 8 Drawing Figures

Fig. 3A
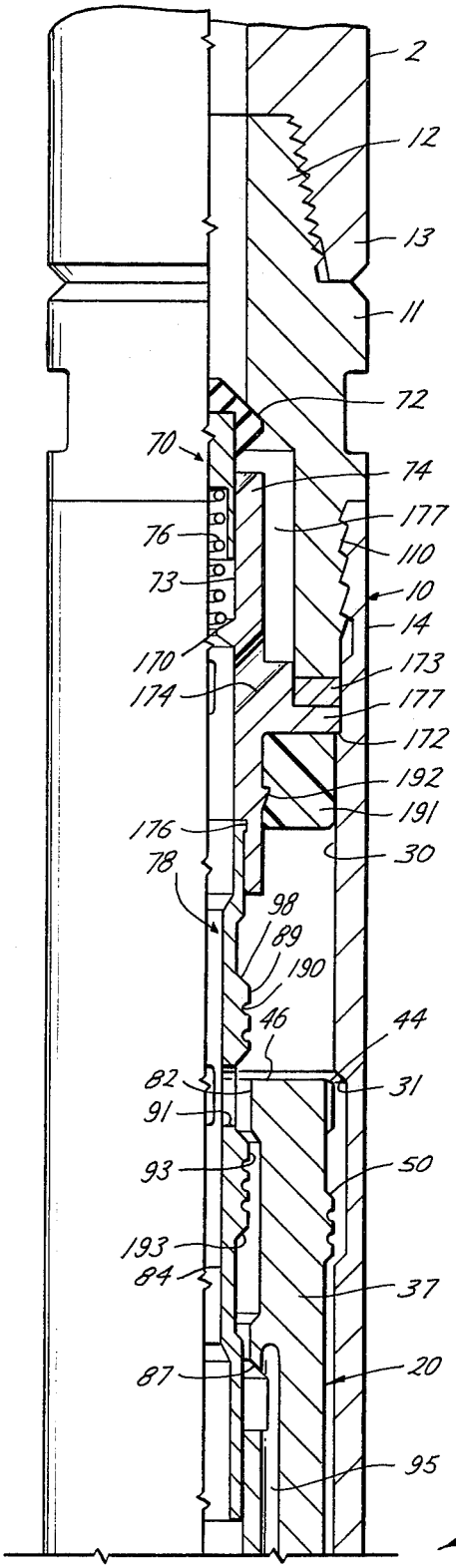
Fig. 3B
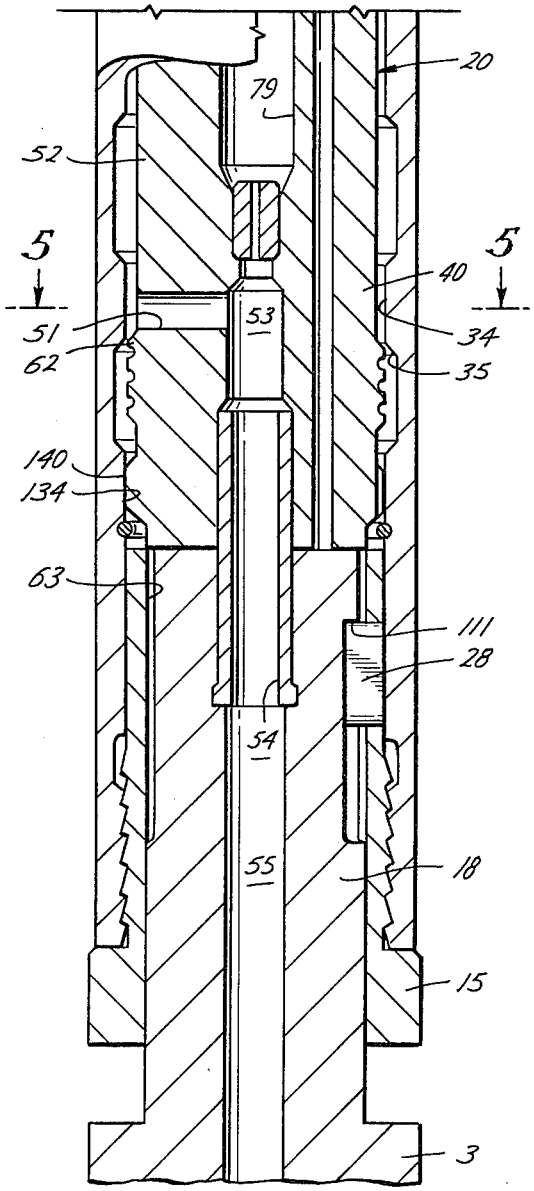
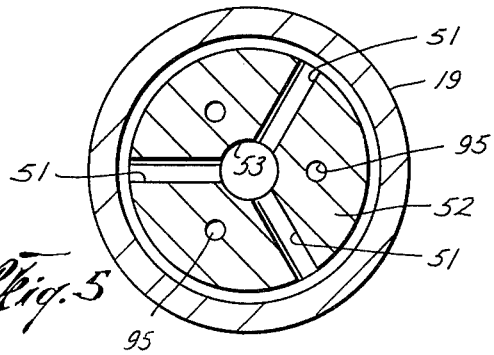
Fig. 5

VARIABLE VOLUME PNEUMATIC DRILL

BACKGROUND OF THE INVENTION

1. Field of the Invention

This invention relates to new and useful improvements in pneumatically operated impact drilling tools and more particularly to pneumatic drills which enter the bore hole and are known as downhole drills. In particular, this invention relates to improved pneumatically operated drills which maybe operated at a variety of selected flow rates and pressures of the compressed air or other pneumatic fluid used in operation of the tool.

2. Brief Description of the Prior Art

The most pertinent prior art relating to this invention are the prior patents of applicant and of other inventors assigned to the assignee of this invention.

Rosco U.S. Pat. No. 3,896,886 discloses an air hammer embodying an outer housing structure connectable to rotatable drill pipe string through which compressed air is conducted. A hammer piston reciprocates in the housing structure, compressed air being directed alternately to the upper and lower ends of the piston to effect its reciprocation in the structure, each downward stroke inflicting an impact blow upon the anvil portion of an anvil bit extending upwardly within the lower portion of the housing structure. The flow of air to the upper and lower ends of the hammer piston is controlled by valve passages formed in the piston and a relatively stationary air supply tube which closes the passage to the lower end of the piston when the outer housing structure is lifted by the drill pipe string to allow the bit to hang down from the housing during the circulation of air for flushing cuttings from the bore hole.

Curington U.S. Pat. No. 3,944,003 discloses an air hammer embodying an outer housing structure connectable to a rotatable drill pipe string through which compressed air is conducted. A hammer piston reciprocates in the housing structure, compressed air being directed alternately to the upper and lower ends of the piston to effect its reciprocation in the structure, each downward stroke inflicting an impact blow upon the anvil portion of an anvil bit extending upwardly within the lower portion of the housing structure. The compressed air acts against the piston over the full internal cross-sectional area of the housing structure in delivering its impact blow, such compressed air acting downwardly over at least a portion of the piston area during its entire downward stroke, including its latter portion, during which the power or impacting air is being exhausted from the housing structure.

Curington U.S. Pat. No. 3,958,645 discloses an air hammer embodying an outer housing structure connectable to a rotatable drill pipe string through which compressed air is conducted. A hammer piston reciprocates in the housing structure along flexible inlet and outlet tubes, compressed air being directed alternately to the upper and lower ends of the piston to effect its reciprocation in the structure, each downward stroke inflicting an impact blow upon the anvil portion of an anvil bit extending upwardly within the lower portion of the housing structure. The piston contacts the housing structure at the upper and lower portions of the piston only, so that the piston can deviate upon flexing of the housing structure under load, and not bind in the housing structure, as permitted by the flexible inlet and outlet tubes. Excess compressed air is permitted to bypass through an orifice in the piston itself, to assist in cleaning the bore hole of cuttings and to avoid excess back pressure in the tool above the piston, resulting from the excess air delivered by the air compressor.

The patents described above define and claim features of a commercially available pneumatic downhole hammer, viz. the Model D-2 air hammer, manufactured and sold by the assignee of this invention, Baker Drill, Inc. The Baker Drill Model d-2 air hammer is designed to operate at a low air flow for low air pressures and at a high air flow for high air pressures. It has recently been observed that many drillers desire to use compressed air rigs which operate at high pressure but relatively low volume. As a result, there has been a demand for air hammers which will operate with a low volume of compressed air when run at high pressure.

SUMMARY OF THE INVENTION

This invention relates to an improved penumatically operated drilling tool of the downhole type which is adapted for connnection in a string of drilling pipe and supplied with compressed air or other pneumatic fluid therethrough. The tool includes a housing having an upper sub closing the upper end thereof and adapted for connection to the lower end of the string of drilling pipe. An anvil member is slidably positioned in the lower end of the housing and extends outside the housing, terminating at its lower end at a bit member. The anvil member has a passage way extending longitudinally therethrough. A hammer piston is positioned for reciprocal movement in the housing above the anvil member and is movable to strike the anvil member repeatedly. The hammer piston has a longitudinally extending passageway. The feeder tube is secured to a supporting member on said upper sub and extends slidably into the upper end of the longitudinal passageway of sub hammer piston. An exhaust tube is secured in the anvil member passageway and extends slidably into the lower end said hammer piston passageway. A system of passages and under cuts and valving surfaces define a passageway extending from the upper sub to the upper end of the hammer piston when in an up position and extending to the lower end of the hammer piston when in a down position. Similarly, a system of under cuts and valving surfaces define a passageway extending from the lower end of the hammer piston to the exhaust tube when the hammer piston is in an up position and extending from the upper end of said piston to said exhaust tube when said hammer piston is in a down position. An annular plug member fits on the supporting member for the feeder tube and determines the volume of compressed air or other pneumatic fluid required to operate the hammer piston at any predetermined pressure. The size of the annular plug member is related to the proportions of the feeder tube to determine both the volume of air utilized at a particular pressure and the timing of operation of the hammer piston. The feeder tube and annular plug member are preferably made of a flexible plastic material and are made available in matched sets and are removably positioned on the supporting member in the air hammer so that like sets of different size and proportion may be substituted to permit the operation of the air hammer at any of a variety of air pressures or air flow rates.

BRIEF DESCRIPTION OF THE DRAWINGS

FIGS. 3A and 3B are viewed similar to FIGS. 1A and 1B, illustrating the relationship of parts when the air hammer has been elevated from the bottom of the hole with the drill bit in a dropped position, allowing air to be circulated through the apparatus, FIG. 3B being a lower continuation of FIG. 3A.

FIG. 5 is a view in cross-section taken on the line 5—5 of FIG. 3B.

DESCRIPTION OF THE PREFERRED EMBODIMENT

Figure 1A:
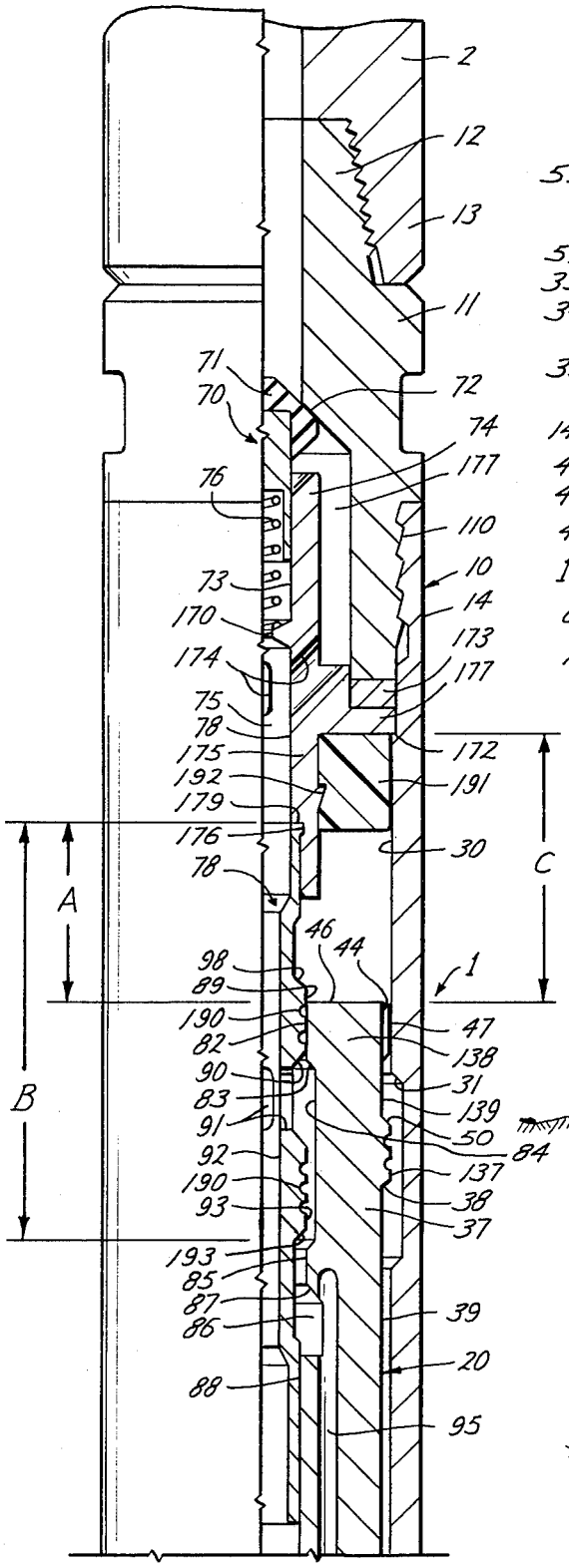
FIGS. 1A and 1B together constitute a longitudinal section through an apparatus embodying the invention, with parts in their relative position or drilling and in which the hammer piston has completed delivering an impact blow against the anvil bit, FIG. 1B being a lower continuation of FIG. 1A.

As shown in the drawings, an air hammer apparatus 1 is provided which is secured to the lower end of a string of drill pipe 2, by means of which the apparatus is rotated to correspondingly rotate an impact anvil bit 3 used for drilling a bore hole 4, the apparatus delivering repeated impact blows upon the anvil bit by forcing compressed air or other pneumatic fluid down the drill pipe for actuating the apparatus and cleaning the cuttings from the bottom 5 of the hole.

The apparatus is relatively simple, consisting of an elongated housing 10 that includes an upper sub 11 having an upper threaded pin 12 for threaded attachment to the lower end 13 of the string of drill pipe 2, and extends to the drilling rig (not shown) at the top of the bore hole 4. The sub 11 is threadedly secured, as at 110, to the upper portion of an elongate housing section 14, which can be of one piece, the lower end of which is threadedly secured to a lower housing head or drive sub 15, the lower end 16 of housing section 14 bearing against an upwardly facing shoulder 17 formed on drive sub 15.

An elongated anvil portion 18 of the anvil bit 3 is piloted upward within driver sub 15 and lower portion 19 of the housing section 14, the hammer piston 20 being reciprocable in the housing section above anvil 18 to deliver rerepeated impact blows thereagainst. Anvil 18 is preferably formed integral with drill bit portion 21, which has suitable cutting elements 22, e.g. sintered carbide inserts, mounted in its drilling face 23 for impacting against the bottom 5 of bore hole 4, to produce cuttings therein, the cutting elements 22 also acting against the side of bore hole 4 adjacent to its bottom to insure the production of a bore hole of the desired diameter.

During the reciprocation of hammer piston 20 in the housing to deliver impact blows upon anvil bit 18, drill pipe string 2 and housing structure 10 are rotated at a predetermined speed, e.g. 10 to 20 r.p.m., to correspondly rotate anvil bit 3 and insure an impacting action of cutting members 22 over substantially the entire cross-sectional area of the bottom 5 of the hole 4. During the impacting action, suitable drilling weight is imposed on anvil bit 18 and housing structure 10, such drilling weight being transferred from the lower end 24 of drive sub 15 to an upwardly facing shoulder 25 of the bit. The rotary drive itself is transferred from housing structure 10 to anvil 18 through a suitable spline connection 26, which can assume several different forms, the particular drive connection illustrated constituting no porportion of the present invention. This drive connection is illustrated in several prior patents issued to applicant.

Figure 4:
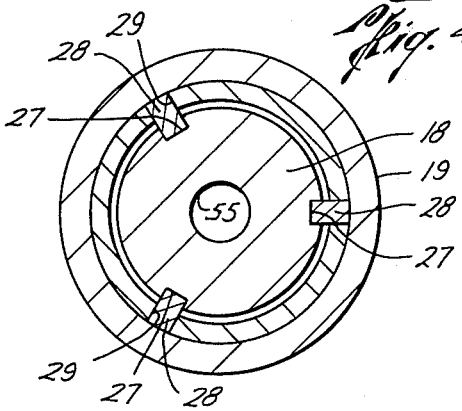
FIG. 4 is a view in cross-section taken on the line 4—4 of FIG. 2B.

In general, the upper portion of the anvil 18 has circumferentially space elongate grooves 27 (FIG. 4), in which segments 28 are disposed, these segments being carried in circumferentially spaced windows 29 in drive sub 15. Grooves 27 are substantially longer than the length of segment 28, permitting relative longitudinal movement of anvil bit 3 with respect to the housing structure 10. The rotary effort is transferred from the housing section 14 to the drive sub 15 by means of the threaded connection 130 and from the side of windows 29 to segments 28, from where the turning effort is transmitted through segments 28 and grooves 27 to the anvil bit.

The housing section 14 includes an upper inner cylindrical housing wall 30, the lower end 31 of which constitutes an upper housing flow control corner at the upper end of an elongated internal circumferential exhaust groove 32 of a substantially larger internal diameter in the diameter of the inner cylindrical housing wall 30. Disposed substantially below the lower end 33 of exhaust groove 32, housing section is provided with a lower inner cylindrical housing wall 34, which may be of the same internal diameter as the upper housing wall 30, the upper end of the lower wall being the housing lower flow control corner 33. The lower end 35 of lower inner cylindrical housing wall 34 provide a bypass corner at the upper end of an enlarged internal diameter circumferential bypass groove 36. Similarly, the housing has an enlarged internal diameter circumferential bypass groove 136 immediately above the lower corner 33.

The elongate hammer piston 20 includes an upper piston portion 37 having an external diameter 137 conforming to the diameter of the upper inner cylindrical housing wall 30, this upper piston portion terminating at the upper end 38 of an elongate external circumferential exhaust groove 39 or piston relief portion of a lesser external diameter than the upper piston portion 37. This external exhaust groove terminates at a lower piston portion 40 having an external diameter conforming to the internal diameter of the lower inner cylindrical housing wall 34. Below its lower piston portion, the hammer is of a reduced external diameter 41, providing a downwardly facing shoulder 42 which may, upon removal of the anvil bit 3 from the housing 10, engage a limit ring 43 mounted in the housing section 14, to prevent the piston 20 from inadvertently dropping out of the housing structure. The hammer piston has an upper guide portion 138 separated by a circumferential groove 139 from the upper piston portion 37. This upper guide portion has a plurality of circumferentially spaced relief portions 44 which may be formed by cords extending from the upper end of groove 139 to the upper end of 46 of the guide portion 138, there being circumferentially spaced elongate arcuate sections 47 between the relief portions 44 having the same external diameter as the upper piston portions 37 and assisting in guiding the hammer piston 20 in its reciprocation along the inner wall of the housing section 14.

Figure 1B:
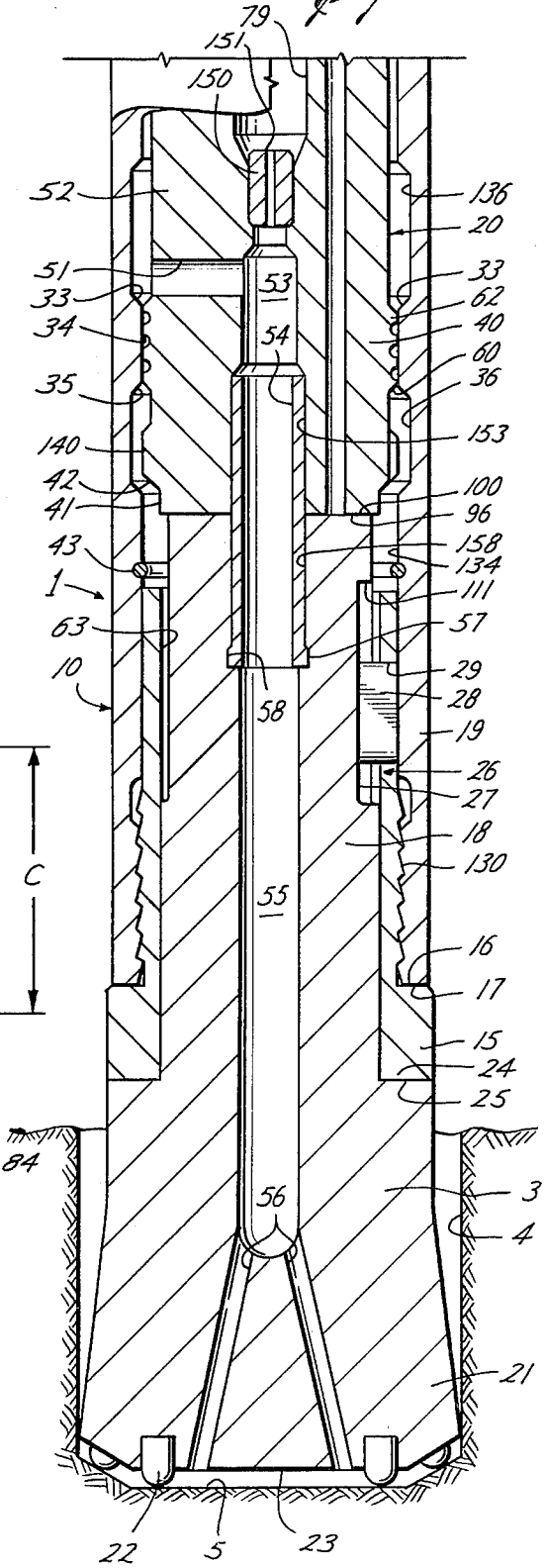

As described herein below, when the hammer piston 20 is at the lower end of its stroke, as shown in FIGS. 1A and 1B, a flow control piston corner 50 at the upper end of the piston portion 37 is spaced below the upper housing flow control corner 31, allowing air in the housing above the piston 20 to flow down through the passages 44 and into the internal circumferential exhaust groove 32, around the upper piston portion 37, then through the lower portion of the groove 32 and the grooves 39 and 136 into radial exhaust ports 51, formed through the hammer piston below its intermediate piston wall 52, that communicate with a elongate central piston cavity 53 into which an exhaust tube 54 extends upwardly from the anvil 18, the tube forming a continuation of exhaust passage 53 and communicating with an exhaust passage 55 through the anvil and one or a plurality of exhaust passages 56 extending downwardly through the bit 21 and opening outwardly thereof for the purpose of removing cuttings from the bottom 5 of the hole. The tube 54 makes a slidable seal with the wall 153 of the piston cavity 53, being secured to the anvil 18 by a outwardly extending tube flange 57 being received within an inner circumferential groove 58 in the anvil. The tube may be made of a suitable elastic or plastic material, such a Delrin, which permits it to be inserted within the anvil passage, the flange 57 contracting sufficiently until it is opposite the circumferential groove 58, whereupon the tube flange can snap outwardly into groove 58 and thereby lock the exhaust tube 54 in the anvil 18.

When piston 20 is shifted upwardly within the housing on its return stroke, the return air corner 60 at the lower end of the lower piston portion 40 will be disposed above the housing lower flow control corner 33 (FIGS. 2A and 2B), whereupon the compressed air below the piston can exhaust into the internal circumferential housing groove 136 and flow through the exhaust ports 51 and exhaust passages 53, 55, 56 to the bottom 5 of the bore hole 4. At this time, the upper flow control piston corner 50 will be disposed above the upper housing flow control corner 31, which will seal the upper piston portion 37 against the upper inner cylindrical housing wall 30, whereupon compressed air can drive the piston 20 downwardly on its hammer or power stroke. When the return air corner 60 moves below the housing lower flow control corner 33, the air below the piston and within the housing, which remains after the lower piston portion 40 is closed within the lower end of the cylindrical housing wall 34, is subject to compression, but such air will be at a relatively low pressure.

As described herein below, in the event the apparatus elevated to raise the bit from the bottom 5 of the hole 4, the bit will drop downwardly until its upper anvil shoulder 111 engages the upper ends of the segments or keys 28. This will allow the upper piston bypass corner 62 of the lower piston portion 40 is shift below the housing bypass corner 35 at the lower end of the lower inner cylindrical housing wall 34, the upper flow control piston corner being well the upper housing flow control corner (FIGS. 3A and 3B). Accordingly, compressed air above the piston can flow through the passages 44 and the circumferential exhaust grooves 32, 39, 136 into the air bypass groove 36 below the lower housing wall 34, the air passing downwardly through the passage 63 in the upper portion of driver sub 53 and into the clearance around drive segments 28 and into grooves 27 in anvil 18, and outward through the clearance between drive sub 15 and anvil 18.

Compressed air for reciprocating in the hammer piston 20 passes downwardly through the string of drill pipe 2 and into the upper housing sub 11, flowing past a downwardly opening check valve 70. The check valve includes valve head 71 which is urged toward a closed position against valve seat 72 in sub 11. Valve head 71 fits slidably within the bore 73 of an upwardly extending tubular extension 74 on valve cage 75. A spring 76 is positioned within the bore 73 and rests at one end against inwardly extending circumferential flange 170 and at the other end urges valve head 71 toward closed position against valve seat 72. Valve cage 75 has a peripheral flange 171 which seats against shoulder 172 in housing section 14. Make-up ring 173 is positioned against the upper side of flange 171 and is engaged by the lower end of upper sub 11 when screw connection 110 is tightened. When valve head 71 is moved away from valve seat 72 by pressure of compressed air, the compressed air flows into annular passage 177 and thence through passages 174 in valve cage 75 into the bore 178 of the downwardly extending tubular extension 175 of cage 75.

The inlet air under pressure is caused to flow alternately into the housing below the piston 20 and the housing above the piston, to effect reciprocation of the hammer piston. A feeder tube 78 is mounted in the bore 178 of tubular extension 175 of valve cage 75. The upper end of feeder tubes 78 has a flange 179 which fits in groove 176 into tubular extension 175 of valve cage 75. Feeder tube 78 projects downwardly into an upper elongate central piston cavity or chamber 79 above the intermediate piston wall 52, which separate the upper chamber 79 from the lower chamber 53. An orifice member 150 having an orifice 151 may be press fit in the wall 52. Feeder tube 78 is secured in valve cage 75 by a flange fitting into a groove therein as described above. Feeder tube 78 is made of a flexible plastic or elastic material, such as Delrin, which permits the upper portion of the tube to be deflected inwardly of the valve cage passage 178 below the circumferential groove 176, and when the flange 179 becomes aligned with the groove, the flange inherently expands outwardly into the groove to secure the feeder tube in the valve cage 75. The elastic nature tube is such that it also provides a slidable seal with the inner walls of the piston 20, as explained herein below.

The piston has an elongate upper cylindrical surface 82 opening through its upper end 46 and terminating at an inner, upper flow control piston corner 83, which is the upper end portion of an elongate internal circumferential impact passage groove 84 having a substantially larger internal diameter than the inside diameter of the upper piston portion surface 82. The circumferential impact passage groove 84 terminates at an intermediate inner cylindrical piston wall 85, which may have the same internal diameter as the upper cylindrical piston wall 82, the intermediate wall terminating at an internal circumferential return passage groove 86 formed in the piston and terminating at a lower flow control piston corner 87, which is the upper end of a lower internal piston seal portion 88 that extends upwardly from the intermediate piston wall 52. Feeder tube 78 has an upper external cylindrical sealing surface 89 relatively slidably sealable with the upper piston wall 82 and terminating in an external circumferential inlet groove 90 communicating with radial inlet ports 91 opened to the central inlet passage 92 through the tube. Below this circumferential inlet groove 90 the tube is formed as a lower cylindrical sealing surface 93 slidably and sealingly engageable with the intermediate inner cylindrical wall 85 and also with the lower piston wall 88. Labyrinth grooves 190 are provided in the tube surfaces 89 and 93 to enhance the sealing effectiveness of the surfaces 89, 93 with the walls 82, 85.

Figure 2A:
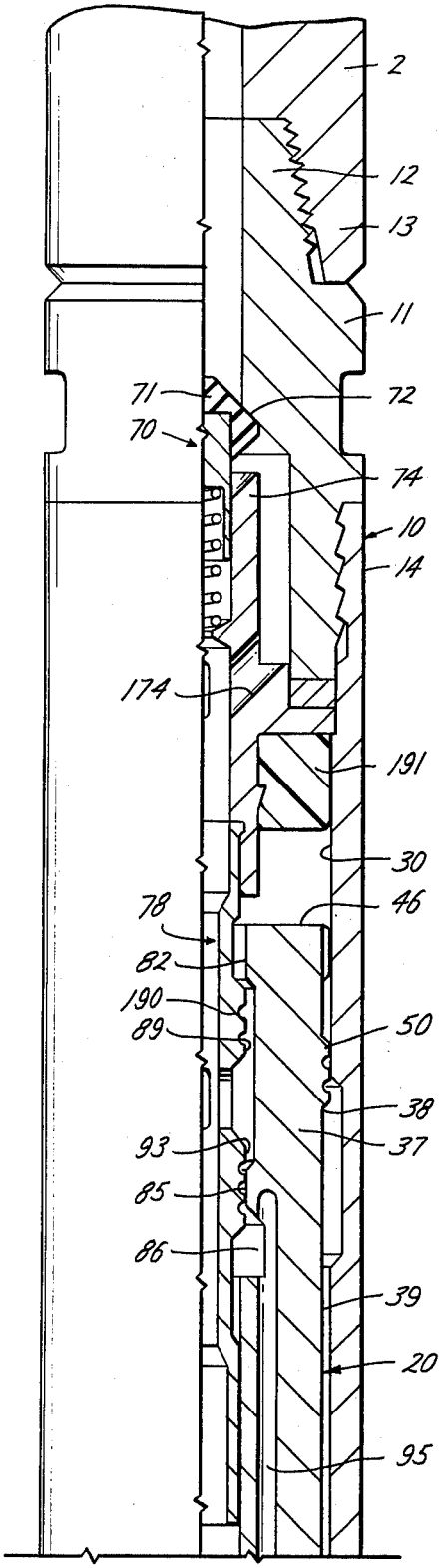
FIGS. 2A and 2B are viewed similar to FIGS. 1A and 1B with the hammer piston approaching tis upper position, FIG. 2B being a lower continuation of FIG. 2A.
Figure 2B:
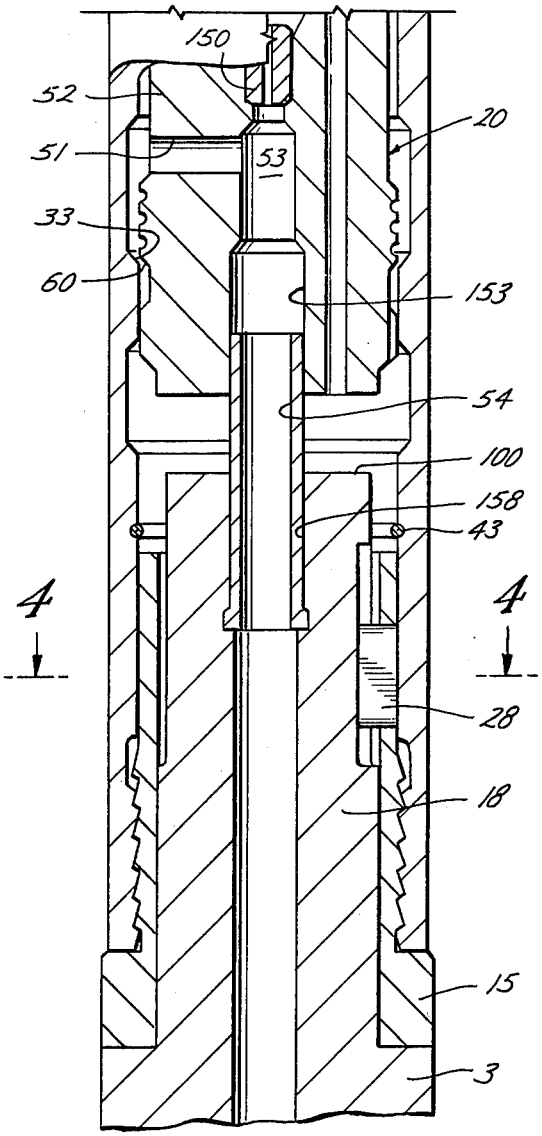

When the piston 20 is in its lower most operative position with the drill bit 21 pressed against the bottom 5 of the bore hole 4, compressed air can flow downwardly through the inlet passage 92, discharging into the circumferential return passage 86 that communicates with the upper portion of one or more longitudinal return passages 95 extending downwardly through the hammer piston and opening outwardly through its lower end 96. When the hammer piston 20 moves upwardly within the housing 10 and along the feeder tube 78, the lower flow control piston corners 87 first shifts upwardly over the flow control housing tube corner 193 to disrupt communications between the inlet passage 92 and the return passages 95, continued upward movement of the piston then placing the inner upper flow control piston corner 83 above the upper flow housing tube corner 98, which then allow compressed air to flow from the inlet passage 92 through the ports 91 into the circumferential inlet groove 90 into the internal circumferential impact passage groove 84 and thence into the housing above the upper end 46 of the piston (FIGS. 2A & 2B). At this time, the upper piston corner 50 will have moved partially above the upper housing flow control corner 31, so that the air under pressure between the upper end 46 of the piston and the underside of valve cage 75 connect downwardly on the piston, urging it in a downward direction.

The piston 20 will be shifted downwardly until the upper flow control piston corner 83 moves below the flow control housing tube corner 98, which shuts off air pressure into the housing above the piston, the piston continuing to move downwardly, as the compressed air expands, until the outer upper flow control piston corner 50 moves below the upper housing flow control corner 31, which then permits air above the piston to pass through the passages 44 into the circumferential exhaust grooves 32, 39, 136 and through the exhaust ports 51 and exhaust passages 53, 55, 56 to the bottom of the hole below the drill bit, the hammer piston being driven against the upper face 100 of the anvil to deliver an impact below to the anvil bit. As the piston nears the end of its downward stroke, the lower flow control piston corner 87 will move below the lower flow control housing tube corner 193, thereby allowing compressed air to flow from the inlet passage 92 through the ports 90 into the groove 84, flowing through the annular passage between the tube and wall 85 into the return passage groove 86, passing downwardly through the longitudinal return passages 95 to the lower end of the piston, such air then moving the piston in an upward direction, until the lower flow control piston corner 87 passes upwardly beyond the lower flow control housing tube corner 193 once again, to shut off the flow of air into the return passages 95. When this occurs, the outer upper flow control piston corner 50 moves above the upper housing flow control corner 31 to shut off the exhaust of air from the housing reaching above the piston 20, the compressed air below the piston expanding and driving the hammer piston upwardly toward the valve cage 75. Before reaching the valve cage 75, the inner upper flow control piston corner 83 will have shifted upwardly along feeder tube 78 to a position above the upper flow control housing tube corner 98, allowing air under pressure to flow from the inlet passage 92 through the impact passage grooves 90, 84 to a position in the housing above the piston 20.

The upward travel of the piston 20 is cushioned by the compression of air remaining in the housing of the piston. However, the piston will still move upwardly sufficiently to place the lower corner 60 of the lower piston portion 40 above the housing lower flow control corner 33, which then permits compressed air below the piston to travel into the internal circumferential exhaust groove 32 and through the exhaust ports 51 into the exhaust passages 53, 55, 56 for discharge from the drill bit. The compressed air in the housing structure above the piston then expands to drive the piston downwardly, and the foregoing cycle of operation is repeated, the piston reciprocating to deliver repeated impact blows against the anvil portion 18 of the anvil bit 3, while the drill string 2 and the entire apparatus 1 is being rotated, to insure that the drilling or cutting elements 22 will cover substantially the entire cross-sectional area of the bore hole bottom 5.

The hammer piston also has a lower guide portion 138 spaced downwardly from the lower piston portion 40 and slidable along the walls 34 and 134 below the groove 36 when the piston is approaching or is at its upper most and lower most positions. The lower guide also has the same relief portions 44 as the upper guide 138.

In the event it is desired to pump compressed air through the apparatus while the drill bit is off bottom, the elevation of the apparatus 1 will cause the impact bit 3 to drop downwardly along the housing until the upper anvil head 111 engages the upper ends of the keys 28 (FIGS. 3A, 3B). The piston 20 will also drop downwardly until its bypass corner 62 is below the bypass corner 35 of the housing 10, the upper corner 62 of the piston being disposed below the upper end of the internal circumferential groove 36. Accordingly, compressed air flowing downwardly through the drill string 2 and into the inlet passage 92 can pass through the inlet port 91 and upwardly to a position above the piston, then flowing downwardly through the upper passages 44 and into the internal circumferential exhaust groove 32, flowing between the external circumferential exhaust groove 39 in the piston and the opposed lower inner cylindrical housing wall 34 into the enlarged diameter groove 36 below the inner cylindrical housing wall, then passing through the lower passages 44 in the lower guide 138 and through the passages 63, 64, 27, 67 to the exterior of the bit. The major portion of the compressed air will flow around the upper piston 37 through the grooves 32, 136, ports 51 and passages 53, 55, 56 to the exterior of the bit, to clean the bore hole 4 of cuttings.

As described above, the exhaust tube or sleeve 54 is made of elastic material, which is a suitable synthetic resin or plastic such as Delrin. This sleeve must make the slidable seal within the wall 153 of the piston cavity 53 to prevent or minimize leakage of air between the tube and the wall 153. Because of the manufacturing tolerances, a perfect alignment between the hammer piston 20 and the anvil 18 may not exist. Accordingly as the piston approaches the anvil and impacts thereagainst, it imposes a lateral force on the exhaust sleeve 54. If the exhaust tube made a close fit with the wall 158 of the anvil downwardly from its upper face 100, even a small amount of misalignment between the piston and the anvil would cause a high shearing stress to be imposed on the exhaust tube 54, resulting in fatigue failure of the exhaust tube after a relatively short period of use of the apparatus.

The above difficulty is overcome in the apparatus illustrated by providing a very slight relief between the exterior of the exhaust tube or sleeve 54 and the wall 158 of anvil 18, such relief extending downwardly from the upper anvil face 100. The relief may be in the form of a very slight counterbore or a slight thinning of the wall thickness of the exhaust tube. With this small clearance between the tube and the wall 158 of the bore, any misalignment between the piston and anvil 18 will not produce a high shearing stress on the exhaust tube but rather deflect or bend the tube laterally. The bending stresses to which the tube 54 is subjected, as a result of misalignment between the piston 20 and anvil 18, are maintained at a comparatively low value, which prevents the exhaust tube or sleeve 54 from early fatigue failure.

As illustrated in the drawings, an orifice member 150 has been disposed in the intermediate piston wall 52 to permit excess air flow through the feeder tube 78, chamber 79, the orifice 151, central piston cavity 73, exhaust tube 54, anvil passage 55, and its exhaust passages 56 into the well bore. The ability to bypass the volume of air directly to the bit through the choke member insures a maximum hole cleaning action without inhibiting the action of the compressed air on the hammer piston. The choke member is used when the volume of air at a desired unit pressure is much greater than that required to operate the hammer bit, the size of the choke being so selected that the surplus volume of air is permitted to pass directly through the bit. The use of the surplus volume of air for the purpose of cleaning the well bore of cuttings allows the high volume compressor to run at top efficiency. As the surplus volume of air available becomes greater, a larger size choke member 150 would be installed within the piston. When no excess volume of air is available, the choke orifice member 150 would be replaced by a blank member; that is, one having no orifice 151 through it, so that all of the air supplied by the compressor is available reciprocating the piston within the housing.

It is further to be noted that the choke orifice member 150 is to be disposed above the radial exhaust ports 51. The exhaust from the choke orifice 151 flows past the radial ports 51 and tends to reduce the pressure therein, thereby assisting in the flow of exhaust air through the ports and through the passages 53, the tube 54 and the anvil passages 55, 56 into the bore hole.

In the hammer drill illustrated in the drawings, the upper and lower piston portions 37, 40 are at the ends portions of the piston, being spaced longitudinally from one another by a substantial extent, these piston portions being separated by the elongate relief portion 39 which does not contact the wall of the hole. The upper and lower guide portions 138, 140 may contact the upper housing wall 30 and the lower walls 34, 134, but such guide portions and their adjacent piston portions 37, 40 engage their respective housing walls over a relatively small extent. During the drilling operation, the drilling weight and the port imposed on the housing structure 10 causes its flexing, tending to create the binding action on the reciprocating piston 20. Such binding action is minimized by virtue of the minimum wall contact between the greatly longitudinally spaced upper and lower portions 37, 40 of the piston with the housing, and by the fact that the central inlet and exhaust tubes 78, 54 are made of flexible or elastic material. Accordingly, flexing of the housing is accompanied by a companion lateral movement or tilting of the piston 20, so that it can follow the deviations in the housing structure during its reciprocation in the latter. Such lateral shifting is permitted, since the feeder in exhaust tube 78, 54, which are made of flexible or elastic material, can partake of a lateral or bending movement. If these tube members were made of rigid material, the piston could not shift laterally or tilt as a result of deflection of the housing structure 10, creating a binding action between the piston portions 37, 40 of the piston and the housing structure. In the absence of the extensive longitudinal spacing between the piston portions 37, 40 and the flexible tube members 78, 54, a binding action would occur. By virtue of the arrangement illustrated in the drawings, the ability of the piston 20 to shift or tilt as the housing deflects prevents excessive contact pressures between the piston and the housing wall, preventing galling of the parts and ultimate failute of one or more of them.

The apparatus as thus far described, is designed for operation with compressed air at a variety of pressure and flow rate settings as may be encountered in field operation. It is a characteristic of this air hammer design, as far as described above, that an increase in air pressure results in a corresponding increase in the volume of air required to operate the air hammer. Thus, a six inch hammer of this type requires 550 SCFM of air volume to operate at 225 psi. However, there are many drilling rigs in the field with compressor rated at 425–450 SCFM at 250 psi. On these machines, a six inch hammer of this design would operate at 170–185 psi (compressors seldom deliver their rated volume). The drilling operators in the field havd indicated a substantial demand for an air hammer that will operate at a lower volume of air or flow rate when operated at a higher pressure. This demand has currently been met by a total redesign of a variety of commercial air hammers which are designed to run at higher pressure and low volume. There has been a substantial need for a hammer which has flexibility in operation and which can be operated with variable volumes of air and variable air pressures.

The need for an air hammer which will operate with a lower volume of air when operated at higher air pressures has been met in this hammer design by the addition of an annular plug member or plastic ring 191 which fits on tubular extension 175 of valve cage 75 and is held in place by a barb 192 thereon. The addition of annular plug member or plastic ring 191 results in a decrease in the volume of the air space above the hammer piston when in its upper most position. This reduces very substantially the volume of air required to operate the air hammer when operated with higher pressure compressed air.

The variable volume concept which is introduced by the use of an annular plug or plastic ring 191 may be extended to provide an air hammer design which will operate at a large variety of air pressures and flow rates. In order to provide for a air hammer design allowing for a substantial flexibility in air pressure and air flow rates the dimension "C" extending from the flange 171 of valve cage 75 to the upper surface of the hammer piston when in the upper most position is extended so that the volume of the air space above the hammer piston in the absence of annular plug or plastic ring member 191 requires 1,000 SCFM air to operate the hammer at 250 psi. The addition of an annular plug member or plastic ring 191 of predetermined size will adjust the volume of air space above the hammer piston so that 425 SCFM will produce operation at 225 psi. A variety of intermediate size annular plug members or plastic rings can be provided which will produce the desired operation on compressors which operate at higher volumes viz. 600, 700, 800 SCFM etc. When air hammers are used with annular plug members or plastic rings 191 which permit operation at these selected higher volumes, it is preferred to optimize the air hammer operation by adjusting the timing of the air hammer to correspond to the pressure and air flow rate. Optimizing the timing of air hammer operation requires a variation in the spacing of the intake air porting. The dimensions "A" and "B" determine the intake port timing. These dimensions are determined for the particular air pressure and volume of air to be used as determined by the originally selected dimension "C" required for high volume low pressure operation. Dimensions "A" and "B" can be determined for a particular pressure and air flow rate to correspond to the size of a particular annular plug or plastic ring 191. Since the annular plug 191 and feeder tube 78 are both of elastic plastic material and since these are replaceable components, these parts are provided as matched sets. They are preferably color coded so that a given color feeder tube and annular plug are used together to provide the desired operating characteristics and timing of air hammer operation. This replaceability of the feeder tube and annular plug members results in an air hammer design which is fully adjustable in the air pressure and volume of air which can be used. The design of these components is such that it is possible to operate air hammers at a variety of air pressures and to use the lower volumes of air flow as the air pressure is increased and by the corresponding change in the proportions of the feeder tube to optimize the timing of operation of the hammer piston.

I claim:

1. An impact drilling tool for connection in a string of drilling pipe supplied with pneumatic fluid comprising:

an upper sub for connection to said drilling pipe to receive pneumatic fluid therefrom;

a housing with an upper end connected to said upper sub;

an anvil member slidably positioned in the lower end of said housing and having a bit member on its lower end extending outside of said housing;

said anvil member having a passageway extending longitudinally therethrough;

a hammer piston positioned in said housing above said anvil member for reciprocal movement longitudinally of said housing to strike said anvil member repeatedly;

said hammer piston having a first passage way extending longitudinally therethrough;

a feeder tube operatively secured to said sub and extending slidably into the upper end of said hammer piston through its passageway;

an exhaust tube secured in said anvil member passageway and extending slidably into the lower end of said hammer piston passageway;

means including said feeder tube and said hammer piston defining a passageway extending from said upper sub to the upper end of said hammer piston when said hammer piston is in an up position;

means including said feeder tube and said hammer piston defining the passageway extending from said upper sub to the lower end of said hammer piston when said hammer piston is in a down position;

means including said hammer piston and said housing defining a passageway extending from the lower end of said piston to said exhaust tube when said hammer piston is in an up position, means including said hammer piston and said housing defining a passageway extending from the upper end of said piston to said exhaust tube when said hammer piston is in a down position, means determining the volume of pneumatic fluid required to operate said hammer piston at any predetermined pressure and comprising an annular plug member removably positioned within said housing and spaced from said hammer piston when in the up position, and a tubular supporting member secured in the upper end of said housing closing the end space above said hammer piston ;

said feeder tube being supported in said tubular supporting member and said annular plug member being positioned on said tubular supporting member.

2. An impact drilling tool according to claim 1 in which said tube and said annular plug are of plastic and are each removably supported by said tubular supporting member.

3. An impact drilling tool according to claim 2 in which said tubular supporting member includes means to secure said annular plug member thereon.

4. An impact drilling tool according to claim 2 in which said annular plug member and feeder tube are proportioned to determine both volume of pneumatic fluid required at a selected operating pressure and the timing of operation of said hammer piston.

5. An impact drilling tool according to claim 4 in which a plurality of matched sets of feeder tubes and annular plug members are provided which are operable to permit operation of said tool at any of a plurality of predetermined operating pressure and flow rates of pneumatic fluid.

6. A gas powered impact tool which comprises:

a housing adapted to be connected to a source of compressed gas;

an anvil member slidably positioned in the lower end of said housing, extending outside said housing, and having a passageway extending longitudinally therethrough, a hammer piston positioned in said housing above said anvil member for reciprocal movement longitudinally of said housing to strike said anvil member repeatedly and having a first passageway extending longitudinally therethrough;

a feeder tube operatively secured in the upper end of said housing and extending slidably into the upper end of said hammer piston first passageway;

an exhaust tube secured in said anvil member passageway and extending slidably into the lower end of said hammer piston first passageway;

means defining a passageway extending from the compressed gas inlet of said housing to the upper end of said hammer piston when in an up position and extending to the lower end of said hammer piston when in a down position;

means defining a passageway extending from the lower end of said piston to said exhaust tube when said hammer piston is in an up position and extending from the upper end of said piston to said exhaust tube when said hammer piston is in a down position;

means determining the volume of compressed gas required to operate said hammer piston at any predetermined pressure and comprising an annular plug member removably positioned within said housing and spaced from said hammer piston when in the up position; and a tubular supporting member secured in the upper end of said housing closing the end of the space above said hammer piston, said feeder tube being supported in said tubular supporting member, and said annular plug member being positioned on said tubular supporting member.

7. An impact tool according to claim 6 in which said feeder tube and said annular plug are of plastic and are each removably supported by said tubular support member.

8. An impact tool according to claim 7 in which said tubular supporting member includes means to secure said annular plug member thereon.

9. An impact tool according to claim 7 in which said annular plug member and feeder tube are proportioned to determine both the volume of compressed gas required at a selected operating pressure and the timing of operation of said hammer piston.

10. An impact tool according to claim 9 in which a plurality of matched sets of feeder tubes and annular plug members are provided which are operable to permit operation of said tool to any of a plurality of predetermined operating pressures and flow rates of compressed gas.

* * * * *